United States Patent [19]

Karino et al.

[11] 4,333,890

[45] Jun. 8, 1982

[54] SLOW FUEL CONTROLLING DEVICE FOR CARBURETOR

[75] Inventors: Kimiji Karino; Tadao Osawa; Masami Nagano, all of Katsuta; Tokihiko Sakuma; Yuiti Kanazawa, both of Hitachi; Tunemitu Kuroha, Tokaimura; Kanji Tachibana, Hitachi, all of Japan

[73] Assignee: Hitachi, Ltd., Tokyo, Japan

[21] Appl. No.: 144,921

[22] Filed: Apr. 29, 1980

[30] Foreign Application Priority Data

May 9, 1979 [JP] Japan ..... 54/57210

[51] Int. Cl.[3] ..... F02M 3/08

[52] U.S. Cl. ..... 261/41 D; 261/121 A

[58] Field of Search ..... 261/121 A, 41 D

[56] References Cited

U.S. PATENT DOCUMENTS

| | | | |
|---|---|---|---|
| 2,215,683 | 9/1940 | Wirth | 261/41 D |
| 2,399,637 | 5/1946 | Jones | 261/41 D |
| 2,512,085 | 6/1950 | Boller | 261/121 A |
| 2,839,154 | 6/1958 | Sterner | 261/41 D |
| 3,391,909 | 7/1968 | Sarto | 261/41 D |
| 4,087,492 | 5/1978 | Onishi et al. | 261/41 D |
| 4,229,384 | 10/1980 | Karino et al. | 261/121 A |

*Primary Examiner*—Tim R. Miles

*Attorney, Agent, or Firm*—Craig and Antonelli

[57] ABSTRACT

A slow fuel controlling device for a carburetor in which fuel metered by a slow jet is mixed with air induced through a slow air bleed in the form of counter flows and the mixture thus formed is supplied into a portion of the intake passage near a throttle valve, and the diameter of the fuel feed passage is selected to substantially fill said passage with fuel by utilizing capillary action.

5 Claims, 5 Drawing Figures

SLOW FUEL CONTROLLING DEVICE FOR CARBURETOR

BACKGROUND OF THE INVENTION

The present invention relates to an improvement in the slow fuel controller of a carburetor.

Recently, there are increasing demands for carburetors of automobile engines, such as improvement in driveability, economization of fuel, cleaning of exhaust emissions and improved response of fuel supply to varying engine operating condition.

BRIEF SUMMARY OF THE INVENTION

To cope with these demands, the present invention aims at providing as a first object a slow fuel controlling device for internal combustion engines in which the fuel metered by a slow jet and the air supplied through a slow air bleed are made to be mixed with each other in the state of counter-flows thereby to achieve a fine and uniform atomization of the slow fuel.

It is another object of the invention to provide a slow fuel controlling device in which the fuel level of the fuel passage is positioned in the vicinity of the bleed port to improve the response characteristic of fuel supply to achieve a smooth slow speed operation of the engine.

BRIEF DESCRIPTION OF THE DRAWINGS

The attached Figures in combination show a preferred embodiment of the invention in which.

DESCRIPTION OF THE PREFERRED EMBODIMENTS

A preferred embodiment of the invention will be described hereinafter with reference to the accompanying drawings.

Figure 1:
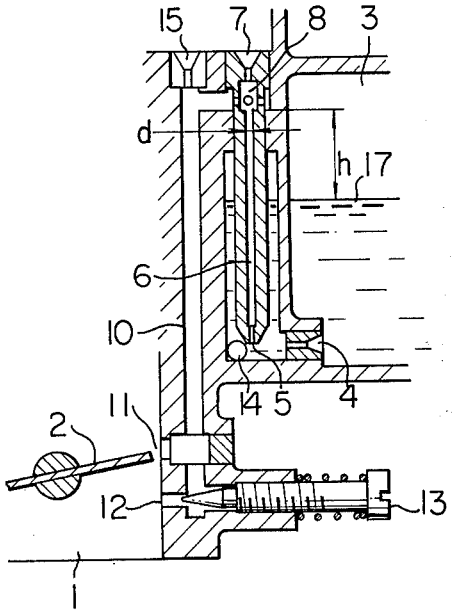
FIG. 1 is a sectional view of a slow fuel controlling device of a down-draft type carburetor.

Referring first to FIG. 1 which is a vertical sectional view showing a slow fuel system of a carburetor, a bypass hole 11 and an idle hole 12 are opened in the vicinity of a throttle valve 2 disposed in an intake passage 1. The cross-sectional opening area of the idle hole 12 is adjustable by means of an adjusting screw 13.

A main jet provided at the bottom of a float chamber 3 is adapted to meter the fuel which is then introduced into a main fuel passage 14. A part of the fuel metered by the main jet 4, however, flows into a vertical fuel passage 6 after a metering by a slow jet 5. The fuel passage 6 is communicated at its upper end with a mixing pipe 8 having a plurality of bleed ports 9. A first slow air bleed 7 opens at an upper portion of the mixing pipe 8. Thus, the fuel passage 6 and the first slow air bleed 7 are disposed to oppose to each other in vertical direction.

The mixing pipe 8 is communicated with a slow passage 10 through an air bleed port 9, while the slow passage 10 opens at its upper end in a second slow air bleed 15. The lower end of the slow passage 10 is in communication with the bypass hole 11 and the idle hole 12.

This slow fuel system operates in a manner stated hereinunder. The opening degree of the throttle valve 2 is small when the engine is operating at a low speed, so that vacuum is generated in an idle hole 12 and in the bypass hole 11. In consequence, fuel and air are sucked through the slow jet 5 and the slow air bleeds 7, 15, respectively. The fuel metered by the slow jet 5 and coming up through the vertical fuel passage 6 is mixed with the air supplied through the first slow air bleed 7 within the mixing pipe 8, and is split into fine streams by the plurality of bleed ports 9 before entering the slow passage 10. The fuel in the gas-fuel mixture is further atomized by the intake air which is introduced through the second slow air bleed 15, and is introduced into the intake passage 1 through the idle hole 12 and the bypass hole 11.

In the ordinary carburetor, the difference h of height between the fuel level 17 in the float chamber 3 and the mixing pipe 8 is as large as 12 mm or more, as will be seen from FIG. 1, so that a considerably long time is required for the fuel to come up from the fuel passage 6 into the mixing pipe 8, if the diameter of the fuel passage 6 is selected to be large.

Figure 3:
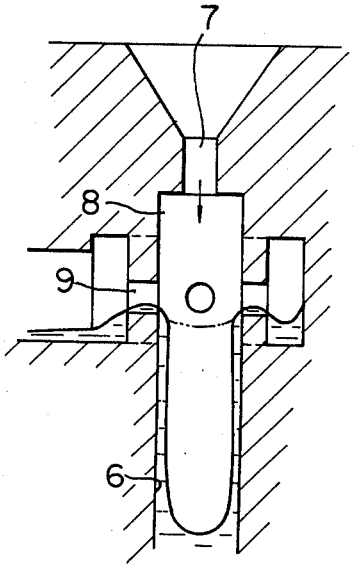
FIG. 3 is an enlarged sectional view of a portion of the carburetor shown in FIG. 1 around a mixing pipe, as observed when the diameter of the fuel passage is increased.

FIG. 3 shows in larger scale the section of the carburetor shown in FIG. 1 around the mixing pipe, with a large diameter of the vertical fuel passage 6. The diameter of passage 6 shown in FIG. 3 is larger than that intended in accordance with the present invention in order to illustrate its behavior if sized in accordance with ordinary carburetor practice. During the idling of the engine, the sucked fuel comes up to the level of broken line in the mixing pipe 8 and the central portion of the fuel column is depressed by the air introduced through the first slow air bleed 7. In consequence, the air-fuel mixture flows in the form of two-phase flow with the central portion thereof constituted mainly by air while the fuel constituting the peripheral film, so as to ensure a high stability of engine operation free of fluctuation.

Then, as the engine is accelerated, the dynamic pressure of the air induced through the first slow air bleed is increased to depress the fuel in the vertical fuel passage 6 as illustrated by full line. In consequence, the fuel is sucked up in the form of liquid film along the wall of the fuel passage 6. An equilibrium between supply and consumption of fuel is maintained if the engine speed is kept constant. However, as the engine is decelerated to the idle speed, the vertical fuel passage 6 is filled up to the level of broken line before the engine speed is lowered. This causes a time lag of supply of the slow fuel.

Figure 5:
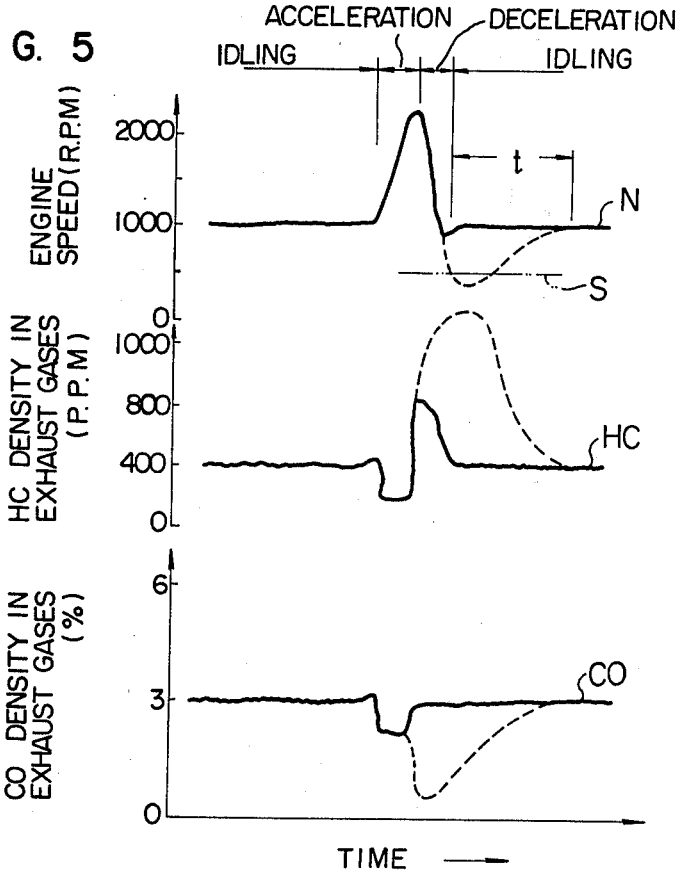
FIG. 5 is a graph showing the engine speed, HC density in the exhaust gases and CO density in the exhaust gases in relation to time as observed during operation of the slow fuel controlling device.

FIG. 5 shows the engine speed, HC density in the exhaust gases and CO density in the exhaust gases from the engine using the slow fuel system shown in FIG. 1, the relation to time, for each case of small diameter of the fuel passage 6 (shown by full lines) and large diameter of the same (shown by broken lines).

Figure 4:
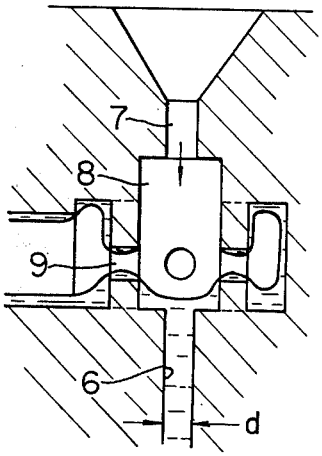
FIG. 4 is an enlarged sectional view of a portion of the carburetor shown in FIG. 1 around a mixing pipe, as observed when the diameter of the fuel passage is decreased.

When the engine is accelerated from idle speed and then decelerated again to the idle speed, the engine operation mode is smoothly changed to idling after deceleration as shown by full lines, if the diameter of the vertical fuel passage 6 is sufficiently small as in the case of embodiment shown in FIG. 4. However, if the diameter of the vertical fuel passage 6 is large as shown in FIG. 3, the engine speed is reduced down to a level which is considerably lower than the ordinary idling speed and even to a level below a threshold level S for maintaining the idling. In addition, the HC density in the exhaust gases are largely increased as shown by broken line curves. To the contrary, the CO density is reduced as compared with the case of normal idling of the engine. This tells the fact that a misfiring is taking place in the cylinder.

Thus, if the diameter of the fuel passage 6 is enlarged, a considerable time lag t is inevitably caused before a steady condition of idling is established after deceleration till the fuel level in the fuel passage 6 is raised to the level of the bleed port 9. During this transient period, the engine may be stalled and the condition of exhaust gases is deteriorated.

It is possible to set the idle speed at a higher level, as a countermeasure for eliminating the above described problem. This countermeasure, however, is not recommended partly because the fuel consumption is increased and partly because the level of engine noise is increased.

Figure 2:
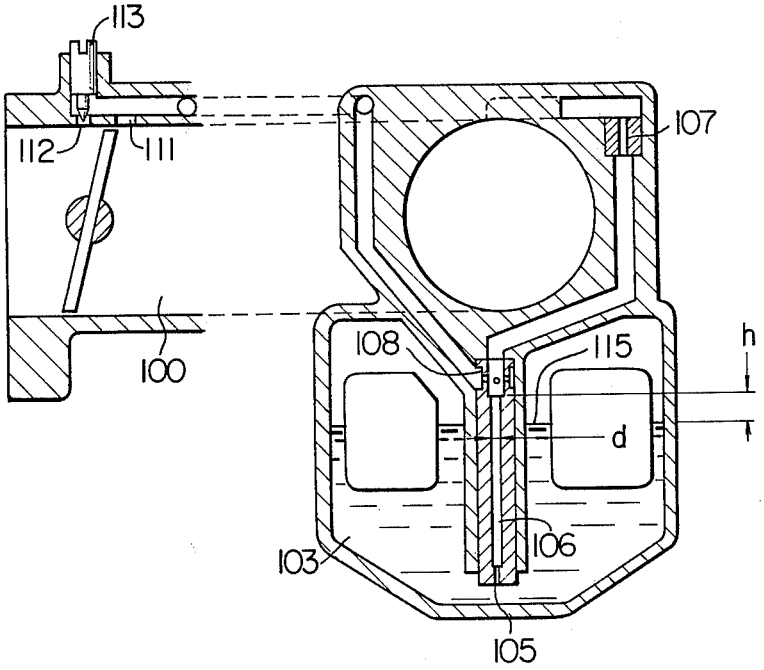
FIG. 2 is a sectional view of a slow fuel controlling device of a horizontal type carburetor.

FIG. 2 shows in vertical section a slow fuel system of a carburetor constructed in accordance with another embodiment of the invention. This carburetor is a horizontal type one, in contrast to the down draft type carburetor shown in FIG. 1. In general, the horizontal type carburetor can have a reduced size even with a large-size float chamber 103.

The fuel 115 in the float chamber 103 is sucked up through a slow fuel passage 106, after a metering by a slot jet 105, and is mixed with bleed air supplied through a slow air bleed 107, within a mixing pipe 108. The fuel mixed with the bleed air then flows into an intake passage 100 through a bypass hole 111 and an idle hole 112 which open in the vicinity of a throttle valve 102. A reference numeral 113 denotes an adjusting screw for adjusting the flow rate of the idle fuel.

Supposing here that the diameter of the fuel passage is as small as 1 mm, a rise of fuel level of about 6 mm is caused by the capillary action of the fuel passage 106 with the engine off. Thus, the fuel can naturally (i.e. with external influences) reach the upper end of the fuel passage 106 if the difference h of height between the lower end of the mixing pipe 8 and the fuel level is selected to be 6 mm or smaller. The reduced diameter of the fuel passage 106 also reduces the area subjected to the dynamic pressure of the air induced through the first slow air bleed, so that the depression of the fuel column by this dynamic pressure is suppressed.

FIG. 4 is an enlarged sectional view around the mixing pipe of the carburetor shown in FIG. 1, but constructed of a diameter d in accordance with the present invention, but from the preceding should be recognized as also being representative of the equivalent portion of the FIG. 2 carburetor. Since the fuel level in the fuel passage 6 is high as illustrated, the dynamic pressure of the air introduced through the first slow air bleed acts to raise the fuel in the form of liquid fuel along the wall of the mixing pipe 8. Consequently, the fuel passes the entire surface of the bleed port 9 in the form of two-phase flow and, accordingly, the atomization of the fuel is promoted.

The full-line curves in FIG. 5 show the characteristics obtained with a carburetor of this embodiment having the fuel passage of reduced diameter. It will be seen from this Figure that the CO density in the exhaust gases is settled without delay after shifting of the engine operation mode from acceleration to deceleration. This shows that the carburetor has a good response characteristic of fuel supply to the change of state of engine operation.

Table 1 shows the result of a test conducted by the present inventors to clarify the relationship between the diameter d of the fuel passage and the rise H of the fuel due to the capillary action. This test was executed at a room temperature using an ordinary gasoline as the fuel. Brass was used as the material for constituting the fuel passage, but it was confirmed that no substantial difference is caused by the use of other metallic material.

TABLE 1

| | | | | | | |
|---|---|---|---|---|---|---|
| d mm | 3 | 2.5 | 2 | 1.5 | 1 | 0.5 |
| H mm | 2 | 2.4 | 3 | 4 | 6 | 12 |

The diameter of the slow jet 5 (105) is about 0.4 mm. The above-mentioned diameter d should be greater than this diameter.

In either case of the down draft type carburetor shown in FIG. 1 and the horizontal type carburetor shown in FIG. 2, the rate of supply of fuel is changed without delay in response to the change of state of engine operation to ensure a smooth and stable engine operation, by arranging such that the fuel level in the fuel passage is positioned in the vicinity of the bleed port. This arrangement is effective also in the suppression of deterioration of the state of exhaust gas, as well as in the reduction of fuel consumption.

Although the invention has been described through preferred forms, it will be clear to those skilled in the art that the described embodiments are not exclusive, and various changes and modifications may be imparted thereto without departing from the scope of the invention.

For instance, the invention can be applied to other types of carburetors than described, e.g. a carburetor having a single slow air bleed if the arrangement is such that the intake air is blown against the upper end of the fuel. Also, an equivalent effect is obtained even when the invention is applied to a two-barrel two-stage carburetor having two independent intake passages.

What is claimed is:

1. A carburetor having a slow fuel system which comprises;

(1) a mixing chamber, (2) metering means for metering flow of the fuel introduced from a fuel float chamber, (3) a fuel passage for introducing the fuel metered by said metering means into said mixing chamber, (4) a slow air bleed passage for introducing air into said mixing chamber, (5) a mixture passage for introducing the air-fuel mixture mixed in said mixing chamber into an intake passage, wherein said fuel passage and said slow air bleed passage are arranged to mix air and fuel in said mixing chamber in the form of counter flows, and the diameter of said fuel passage is selected to substantially fill said fuel passage with the fuel by utilizing capillary action, and wherein the diameter of said metering means is smaller than the diameter of said fuel passage.

2. A carburetor having a slow fuel system according to claim 1, which further comprises a second slow air bleed passage opening in said mixture passage for introducing air.

3. A carburetor according to claim 1, wherein said fuel passage is sized to fill with fuel to a static level which is close to said mixture passage and that, under the effect of air dynamically introduced by said slow air bleed passage, will rise so as to pass along the entire surface of said mixture passage.

4. A carburetor according to claim 3, wherein said fuel passage has a diameter less than approximately 1 mm and the metering means has a diameter of about 0.4 mm, so as to place said static level at least 6 mm above a fuel level in the float chamber.

5. A carburetor having a slow fuel system which comprises;

(1) a mixing chamber, (2) metering means for metering flow of the fuel introduced from a fuel float chamber, (3) a fuel passage for introducing the fuel metered by said metering means into said mixing chamber, (4) a slow air bleed passage for introducing air into said mixing chamber, (5) a mixture passage for taking in a mixture of the fuel and air from said mixing chamber and passing same to an intake passage, (6) an engine for firing the mixture passed to the said intake passage and discharging exhaust gas, wherein said fuel passage and said slow air bleed passage are arranged to mix air and the fuel in said mixing chamber in the form of counter flows, and the diameter of said fuel passage is selected to prevent a large increase in HC density of the engine exhaust gas when the engine is decelerated by minimizing depression of the fuel level within said fuel passage during dynamic introduction of air by said slow bleed passage, wherein said fuel passage is sized to fill with fuel to a static level which is close to said mixture passage and that, under the effect of air dynamically introduced by said slow air bleed passage, will rise so as to pass along the entire surface of said mixture passage, and wherein said fuel passage has a diameter less then approximately 1 mm and the metering means has a diameter of about 0.4 mm, so as to place said static level at least 6 mm above a fuel level in the float chamber.

* * * * *